US011519700B2

(12) United States Patent
Clemons et al.

(10) Patent No.: US 11,519,700 B2
(45) Date of Patent: Dec. 6, 2022

(54) NON-LETHAL SELF-PROTECTION WEAPON

(71) Applicant: Hero Defense Systems, LLC, Henderson, NV (US)

(72) Inventors: David S. Clemons, Henderson, NV (US); Daniel R. Danowski, Loveland, CO (US); Dawson Swan, Loveland, CO (US)

(73) Assignee: Hero Defense Systems, LLC, Henderson, NV (US)

( * ) Notice: Subject to any disclaimer, the term of this patent is extended or adjusted under 35 U.S.C. 154(b) by 0 days.

(21) Appl. No.: 17/518,898

(22) Filed: Nov. 4, 2021

(65) Prior Publication Data

US 2022/0170720 A1 Jun. 2, 2022

Related U.S. Application Data

(60) Provisional application No. 63/119,295, filed on Nov. 30, 2020.

(51) Int. Cl.
*F41H 9/10* (2006.01)

(52) U.S. Cl.
CPC ..... *F41H 9/10* (2013.01)

(58) Field of Classification Search
CPC ..... F41H 9/10; G08B 15/02
See application file for complete search history.

(56) References Cited

U.S. PATENT DOCUMENTS

| | | | | |
|---|---|---|---|---|
| 938,836 | A | 11/1909 | Fessenden | |
| 3,109,253 | A * | 11/1963 | Eig | F41H 9/10 D22/199 |
| 3,161,322 | A * | 12/1964 | Stone | F17C 13/084 366/162.4 |
| D226,908 | S | 5/1973 | Tadlock | |
| 3,791,303 | A | 2/1974 | Sweeney et al. | |
| 3,921,614 | A | 11/1975 | Fogelgren | |
| 4,223,804 | A * | 9/1980 | Morris | B65D 83/201 222/113 |
| 4,402,430 | A * | 9/1983 | Fox | F41H 9/10 222/509 |

(Continued)

OTHER PUBLICATIONS

Piexon Home, "2-shot speedloader, The Piexon JPX2 Jet Protector," https://www.piexon.com/en/jpx2-home/ 7 pgs., Dec. 29, 2020.

(Continued)

*Primary Examiner* — Joshua E Freeman
(74) *Attorney, Agent, or Firm* — Thorpe. North & Western, LLP

(57) ABSTRACT

A gripless, non-lethal, self-protection weapon comprises a clamshell with top and bottom shells pivotally coupled together about a rear hinge and defining a cavity therein. The clamshell has a forward opening and the top shell has a top opening. A panel is slidably carried by the top shell and selectively covers the top opening. A nozzle is carried by the clamshell at the forward opening. A cartridge is removably positioned in the cavity. The cartridge comprises a barrel with an outlet positioned at the forward opening of the clamshell; a compressed gas vessel; and a diverter to redirect compressed gas from the compressed gas vessel in a rearward direction towards an inlet of the barrel in a forward direction.

20 Claims, 8 Drawing Sheets

(56) References Cited

U.S. PATENT DOCUMENTS

D277,126 S 1/1985 Numbers
5,331,523 A * 7/1994 Delzer ..... F21V 33/0064 222/113
D376,766 S 12/1996 Cranford
5,673,819 A * 10/1997 Brunswig ..... F21V 33/0064 222/113
D400,633 S 11/1998 Chapman
6,199,726 B1 * 3/2001 Cardwell, III ..... F41H 9/10 222/402.11
6,393,992 B1 5/2002 Vasel et al.
6,543,365 B1 4/2003 Vasel et al.
7,194,960 B2 3/2007 Vasel et al.
D585,520 S 1/2009 Teig
7,526,998 B2 5/2009 Vasel et al.
7,752,974 B2 7/2010 Wenaas et al.
D688,769 S 8/2013 Lord
8,608,030 B2 12/2013 Vogt et al.
D706,383 S 6/2014 Ben-Yair
8,944,296 B2 2/2015 Vogt et al.
9,386,438 B2 * 7/2016 Hymowitz ..... H04M 11/04
D805,157 S 12/2017 Pennington
10,295,302 B2 5/2019 Lort
D879,236 S 3/2020 Arshad
10,782,109 B1 9/2020 Pedicini et al.
2003/0047105 A1 3/2003 Vasel et al.
2004/0020946 A1 * 2/2004 Fleischhauer ..... F41B 9/0043 222/389
2004/0046669 A1 * 3/2004 Chiapperini ..... G08B 15/004 340/574
2004/0129730 A1 * 7/2004 Parsons ..... F41H 9/10 222/153.11
2005/0016412 A1 1/2005 Vasel et al.
2005/0188886 A1 9/2005 Vasel et al.
2006/0011090 A1 1/2006 Vasel et al.
2006/0027223 A1 * 2/2006 Vasel ..... F41B 11/62 124/57
2007/0039226 A1 * 2/2007 Stokes ..... F41G 1/35 42/146
2007/0167241 A1 * 7/2007 Stethem ..... F41H 13/0018 463/47.3
2007/0238532 A1 * 10/2007 Stethem ..... F41H 13/0018 463/47.2
2007/0245919 A1 10/2007 Vasel et al.
2008/0017179 A1 * 1/2008 Vasel ..... F17C 7/00 124/56
2008/0158859 A1 * 7/2008 McMeekin ..... F41H 9/10 222/113
2008/0245818 A1 * 10/2008 Strickland ..... F41H 9/10 222/113
2009/0013893 A1 1/2009 Vasel et al.
2009/0071459 A1 * 3/2009 Wenaas ..... F41B 11/62 124/71
2009/0266262 A1 10/2009 Vasel et al.
2010/0275895 A1 11/2010 Wenaas et al.
2014/0048561 A1 * 2/2014 Mangold ..... F41H 9/10 222/79
2019/0249698 A1 * 8/2019 Chen ..... F16B 2/22
2019/0301728 A1 * 10/2019 Harvey ..... F41H 9/10
2020/0400304 A1 * 12/2020 Harvey ..... F41H 9/10

OTHER PUBLICATIONS

Byrna, "The Byrna HD (Home Defense)," https.//byrna.com/collections/byrna-hd , 7 pgs., Dec. 29, 2020.

Sabre, "Aim and Fire Pepper Gel with Trigger and Grip Deployment System," https://www.sabrered.com/pepper-spray/aim-and-fire-pepper-gel-trigger-and-grip-deployment-system 3 pgs., Dec. 29, 2020.

* cited by examiner

NON-LETHAL SELF-PROTECTION WEAPON

PRIORITY CLAIM(S) & RELATED APPLICATION(S)

Priority is claimed to U.S. Provisional Patent Application Ser. No. 63/119,295, filed Nov. 30, 2020, which is hereby incorporated herein by reference.

This is related to U.S. patent application Ser. No. 17/065,820, filed Oct. 8, 2020, which claims priority to U.S. Provisional Patent Application Ser. No. 62/913,608, filed Oct. 10, 2019, which are hereby incorporated herein by reference.

BACKGROUND

Personal protection is an ongoing concern for many people. Personal protection often involves carrying a firearm, such a as a pistol. Some jurisdictions restrict and limit an individual's ability to carry a firearm. Some individuals have personal issues with firearms, such as the lethal nature of firearms, risk of accidental discharge, risk of accidental accessibility by a child, etc. Other non-lethal devices have been developed, including pepper spray, mace spray, electroshock weapons such as stun guns, etc. The development of non-lethal self-protection solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
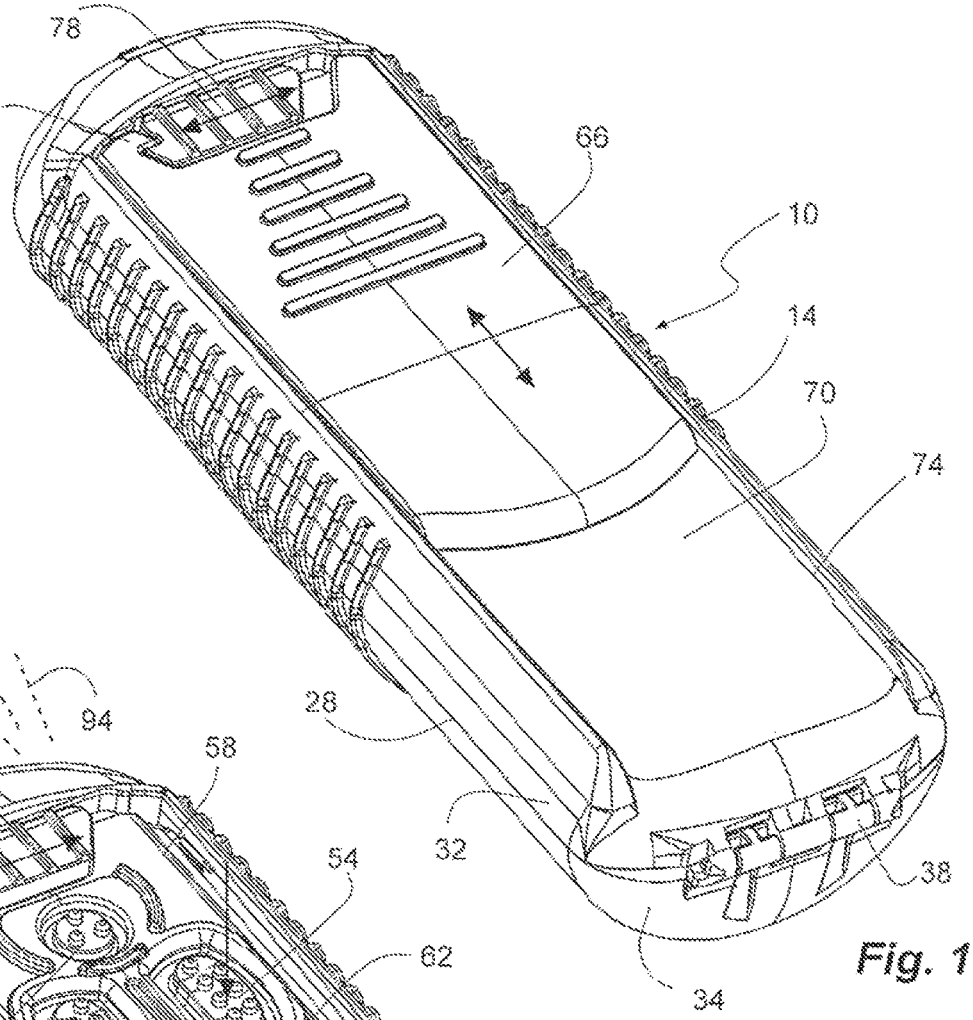
FIG. 1 is a perspective view of a grip-less, non-lethal, self-protection weapon, shown with a panel in a closed position, and shown with a clamshell body in a closed configuration, in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A non-lethal self-defense system and weapon is provided to offer an individual personal protection against aggression or threat while also offering peace-of-mind with respect to risks of accidental access and discharge by a child, personal moral issues associated with taking a life, legal restrictions associated with carrying a firearm, etc. The system is considered to be the smallest and most powerful self-defense product in its class. The system offers a compact and easy to conceal non-lethal tool anyone can use. The system has dual shot, dual trigger design that fits comfortably in the palm of the hand.

The system has a grip-less hand-held body that receives replaceable and interchangeable cartridges with compressed gas, such as nitrogen, to launch projectiles, such as gel, frangible ball, and powder projectiles, under high pressure and at high speeds. The projectiles can contain an irritant, such as specially formulated pharmaceutical-grade formula of organic and synthetic pepper compounds. For example, the irritant can be an active pelargonic acid vanillylamide (PAVA) or an oleoresin capsicum agent. The system can launch projectiles up to 250 feet per second (FPS) from 20 feet away to protect against attackers and animals at close encounters of up to 4 to 15 feet.

The gel projectile can be delivered with high speed and in a heavy liquid gel format, instantly covering the exposed skin, eyes, nose, and mouth of an attacker. The gel projectile can be an effective means of personal protection because the liquid gel instantly covers all exposed areas of the attacker or animal. The gel cartridge can release a focused spray of gel, ensnaring a target with burning irritant that sticks. Excess gel can fall to the ground rather than hanging in the air. The gel can be a good choice for indoor or crowded areas. The gel can be powered by compressed gas in a single, direct impact, high pressure cavity. Firing at over 1000 PSI, the gel can travel up to 200 FPS from up to 15 feet away. The gel cartridge can contain two payloads. Each payload can have 8 ml of gel and can have 10% PAVA.

The frangible ball projectile can have high-speed kinetic energy and impact for stopping power as the frangible ball projectile can hit the target at approximately 200 feet per second and with approximately 15 Joules of energy. On impact, the frangible ball breaks into smaller pieces and releases the active PAVA powder agent inside. The frangible ball creates an ultra-fine cloud of PAVA dust 3-6 feet in size that surrounds the target, causing an immediate reaction. The pepper ingredient causes immediate burning irritation of the eyes, nose, mouth and skin. The large area of effect makes the frangible ball a good choice for wide open spaces and outdoor areas without crowds. Each frangible ball can be about 3 g and can contains about 10% PAVA (active ingredient). The cartridge can hold two projectiles.

In either, ball, gel or powder formats, the active ingredient or active agent causes intense pain, confusion and greatly impairs the vision of an attacker. The disposable, double-shot cartridges provide for ease and speed of reloading.

In one aspect, the system can be grip-less and compact so that it can be carried on a person or stored in close proximity to the individual such as concealed within a pocket, a backpack, or safely stored at home or within an automobile, for example. The system has a wide potential of user/audience groups regarding age, gender, education, economic level, geographic location and interested in having immediate access to a powerful, less-lethal personal protection solution that provides more safety for the user and is reliable in use to demotivate most attackers or animals.

For example, the system can be utilized by an active outdoor enthusiast who likes to walk, jog, run, bike or participate in other outdoor activities that might be away from the populated areas and or protection of crowds or family and friends. As another example, the system can be utilized by someone who finds themselves indoors in an unoccupied or sparsely occupied building, stairway, parking garage, and may be alone and feeling vulnerable. The average person does not carry a personal protection device due to the physical size and weight of the device. Other than small ineffective peppery spray canisters, there are few options that meet this groups' lifestyle and real safety requirements.

As another example, an individual may have a need of a self-defense strategy, but are uncomfortable with carrying a lethal weapon, such as a handgun. The present system provides a system without the pistol grip of a handgun, and can feel more natural and less lethal in the way the unit is held, while the deployment of the unit will only cause temporary disablement to the assailant and is thus a less-lethal solution. The present system may not come under concealed carry laws that would be in place for a concealed handgun or weapon.

As another example, a professional, such as a security guard, that is not allowed to carry a lethal weapon may still need personal protection on the job. The present system presents a compact, lightweight device that can easily be placed in hand, in a pocket or purse with easy access. When an individual begins to feel uneasy of their immediate surroundings, they can easily access the device and be ready to deploy personal protection.

In one aspect, the cartridges provide a power system to develop sufficient static to dynamic energy to instantaneously propel the projectile in a small space to allow the system or weapon to be easily carried, and without a timed build-up of pressure behind a projectile as it travels down an elongated barrel as is common in traditional firearms or even traditional paintball guns. The cartridge provides sufficient back pressure with a seal that holds the projectile in place without releasing the projectile until there is sufficient pressure behind the projectile to project it at speed.

In another aspect, the cartridge can provide a cartridge precursor that can be fitted with different types of projectiles. For example, the same cartridge precursor can be produced and fitted with at least two different projectiles in one aspect, and at least three different projectiles in another aspect, and at least four different projectiles in another aspect. The projectiles can include a frangible ball with a powdered irritant, a gel containing irritant in a syringe carried by the cartridge, a powdered irritant in a shell carried by the cartridge, and a frangible ball containing an inert powder, or a gel or powder that is inert (defining a practice blank or round). Thus, the same cartridge precursor can be used for different mediums.

The term "non-lethal" is used herein to refer to a result that is unlikely and/or incapable in causing death when used with a human or animal greater than ten pounds. The term "self-protection" is used herein to refer to a result that is likely and capable of impeding human or animal aggression. Thus, the non-lethal self-protection system and weapon described herein is intended to stop or resist aggression by a human or animal without causing death.

The term "irritant" is used herein to refer to a material that causes a severe reaction in a human or animal sufficient to impede aggression, but without being lethal. For example, an irritant can comprise pharmaceutical-grade organic and/or synthetic pepper compounds of oleoresin capsicum. As another example, the irritant can comprise active pelargonic acid vanillylamide (PAVA). The irritant can be or can be carried in various forms, including powder and gel.

Referring to FIGS. 1-15, a grip-less, non-lethal, self-protection system and weapon 10 is shown for launching and projecting a non-lethal projectile against a human or animal aggressor and threat in accordance with one embodiment. The system 10 comprises a launch platform, such as a grip-less, hand-held body 14, carrying at least one replaceable cartridge 18. In one aspect, a non-lethal self-protection kit can be provided with at least two cartridges with different projectiles, and/or a third practice cartridge with an inert projectile. The cartridges can be color coded to identify the type of projectile contained therein. In one aspect, the cartridge(s) 18 can be a double shot cartridge(s) configured to carry a pair of projectiles which are separately projected to provide for two shots. Thus, the cartridge(s) 18 can carry a pair of separate components which will be described singularly herein, unless otherwise noted, with the understanding that such description applies to both components.

The grip-less, hand-held body 14 or launch platform can be sized and shaped similar to a TV remote control to facilitate storage and grasping during use. In one aspect, the body 14 can be elongated with a length L along a longitudinal axis 22. The length L can be greater than a width W and a depth or thickness T of the body 14. The width W and the depth or thickness T can both be perpendicular to the longitudinal axis 22 and each other. In another aspect the body 14 can also have a cross-sectional shape perpendicular to the longitudinal axis 22 that is substantially constant along a super-majority of the length L of the body 14. For example, the constant cross-sectional shape can extend for super-majority of the length L of the body 14 greater than 80% in one aspect, greater than 85% in another aspect, greater than 90% in another aspect, and greater than 95% in another aspect. In another aspect, the body 14 can have a flat top and a semi-cylindrical bottom. Thus, the body 14 can be easily contained in a pocket or purse; and can be easily grasped and pointed. The term "grip-less" is utilized herein to refer to the lack of a separate grip that extends transverse from the body 14 and transverse from the longitudinal axis 22, or as a separate and distinct appendage to the body. Instead, the body 14 itself is gripped and resides in the palm of the user's hand.

Figure 2:
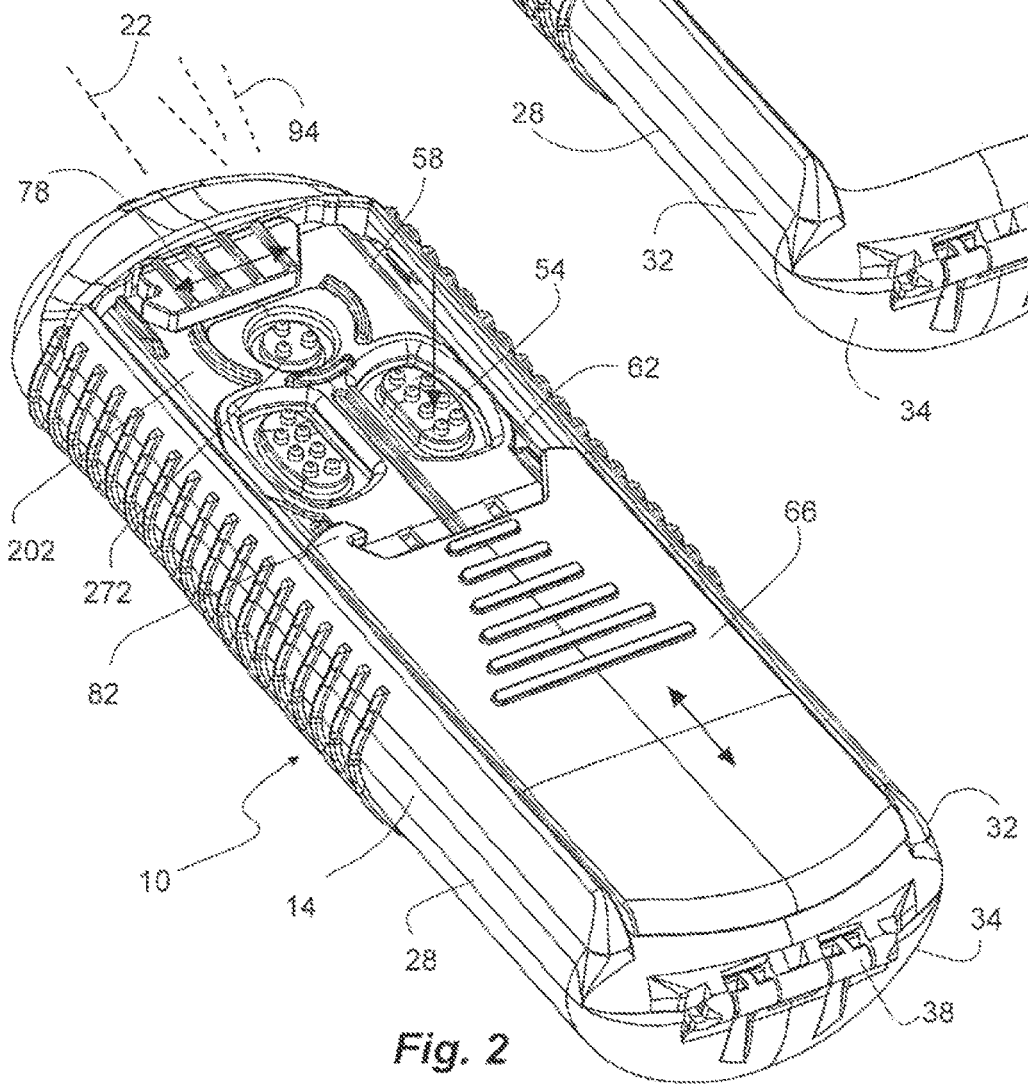
FIG. 2 is a perspective view of the weapon of FIG. 1, shown with the panel in an open position.
Figure 3:
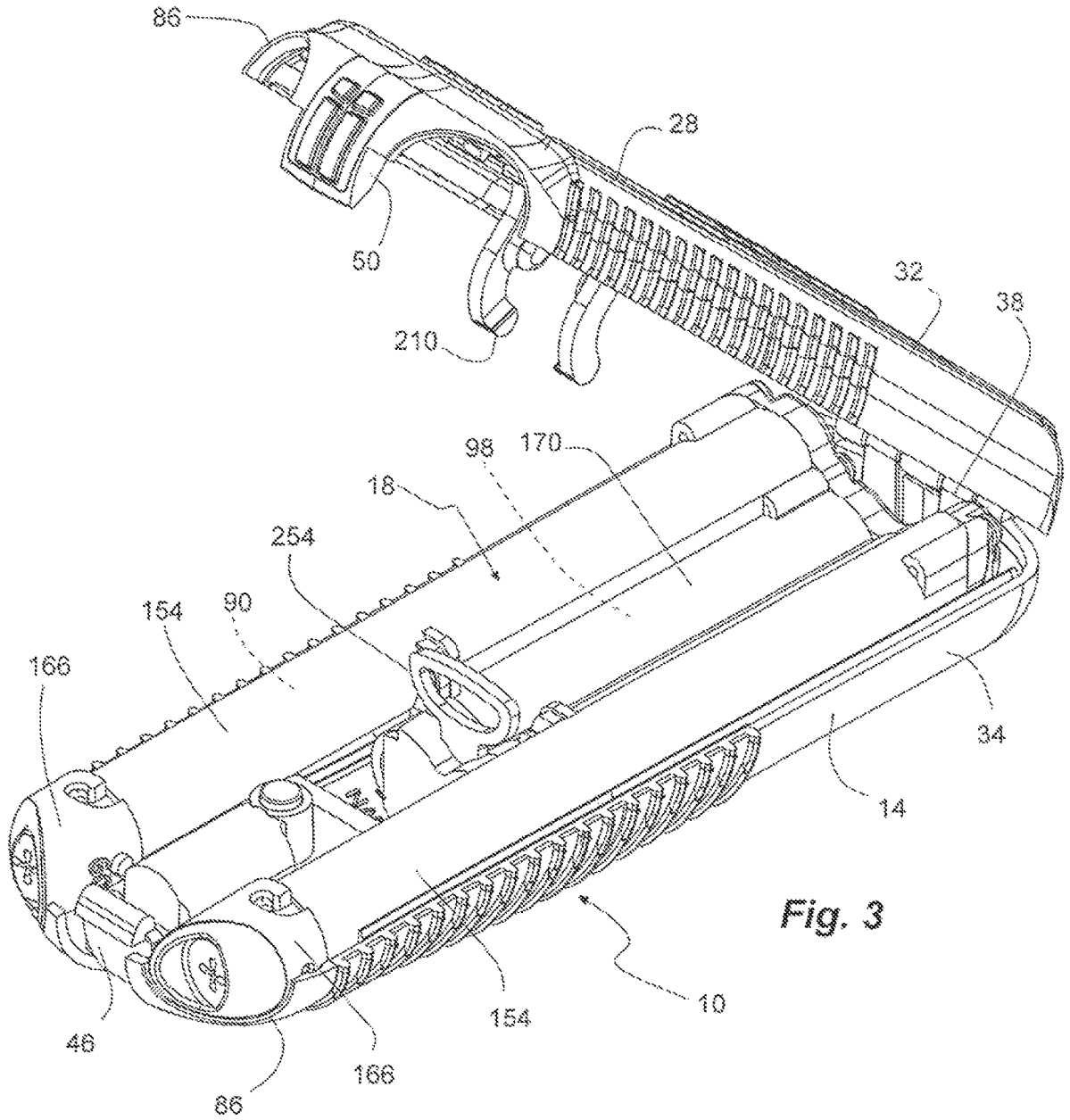
FIG. 3 is a perspective view of the weapon of FIG. 1, shown with the clamshell body in an open configuration, and shown with a cartridge carried within the clamshell body.
Figure 4:
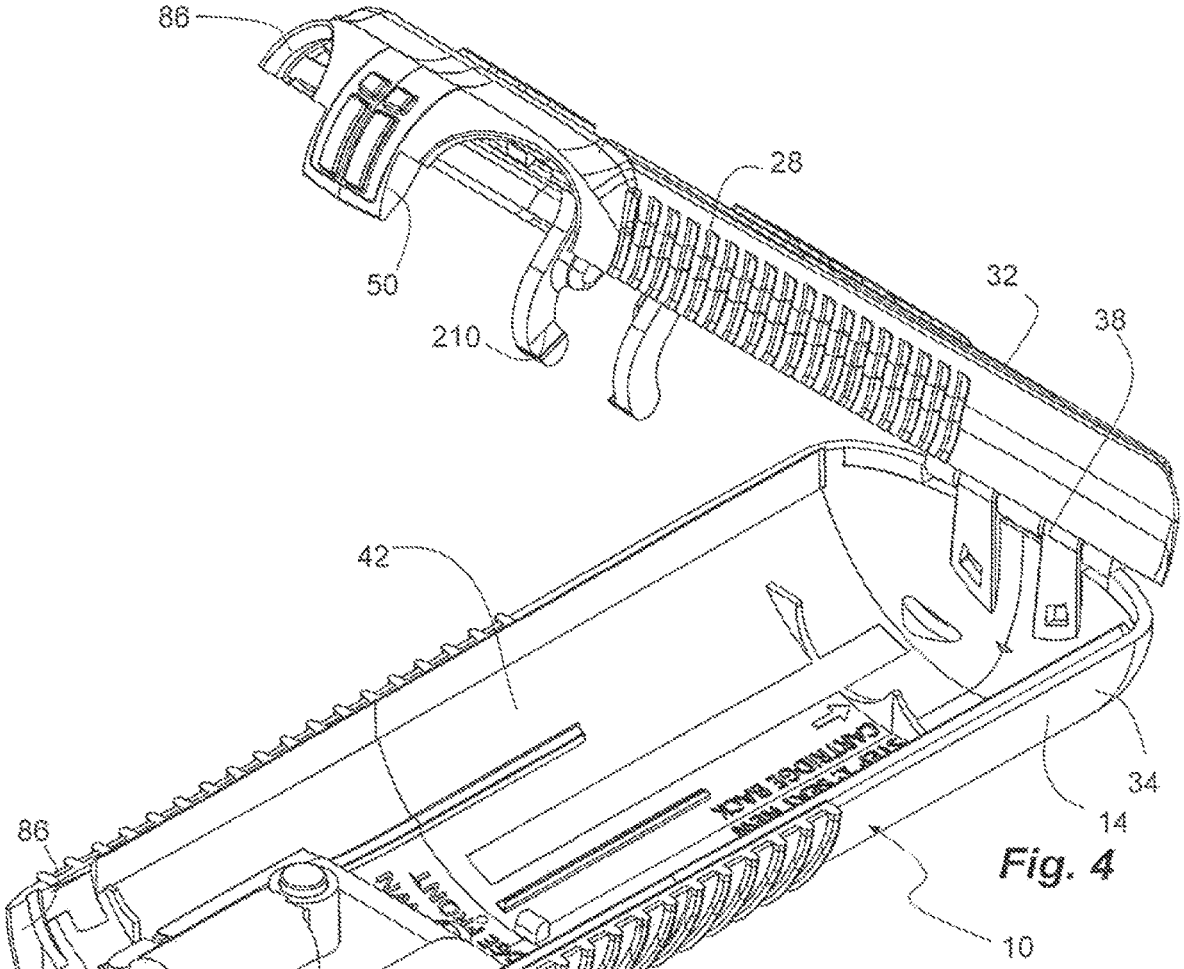
FIG. 4 is a perspective view of the weapon of FIG. 1, shown with the clamshell body in the open configuration, and shown with the cartridge removed from the clamshell body.

The weapon 10 and the body 14 can also comprise a clamshell 28 having top and bottom shells 32 and 34 pivotally coupled together about a rear hinge 38 and defining a cavity 42 (FIG. 4) therein. The shells 32 and 34 can pivot between at least two positions, including: 1) a closed orientation in which the shells 32 and 34 are together and enclose the cavity 42 (FIGS. 1, 2 and 6-10); and 2) an open orientation in which the shells 32 and 34 are separated and exposing the cavity 42 and the cartridge 18 (FIGS. 3 and 4). The clamshell 28 can have a closure, such as a snap fastener, to secure a front end together. The clamshell 28 can have a resilient hook 46 extending from one of the shells 32 or 34, and a notch 50 formed in the other shell 32 or 34, with the resilient hook 46 releasably engaging the notch 50 to selectively hold the shells 32 and 34 in the closed orientation. The resilient hook 46 can have a flexible finger with a hook integrally formed with the shell 32 or 34. Similarly, the notch 50 can also have a flexible finger with a hook integrally formed with the shell 32 or 34. The hook 46 and the notch 50 can have corresponding edges that abut to one another. The body 14 and the clamshell 28, and the top and bottom shells 32 and 34, can be formed of plastic and can be formed by injection molding.

A trigger 54 can be carried by the body 14 and the clamshell 28 to operate and activate the weapon 10. The trigger 54 can be a push-button type of actuation. In one aspect, the trigger 54 can be positioned on the top of the body 14 and the top shell 32. In addition, the trigger 54 can be located on a side of the body 14 and the clamshell 28 away from the distal end, as described in greater detail below. In another aspect, the trigger 54 can be carried by the top shell 32. In another aspect, the trigger 54 can be positioned in a recess 58 in the body 14 and the clamshell 28, such as in the top shell 32. The trigger 54 can be accessible through a top opening 62 to the recess 58 in the body 14 and the clamshell 28, such as in the top shell 32. The trigger 54 can be operable to release propellant and irritant, as described in greater detail below. In another aspect, the trigger 54 can comprise a pair of triggers that are separate and distinct from one another.

Figure 6:
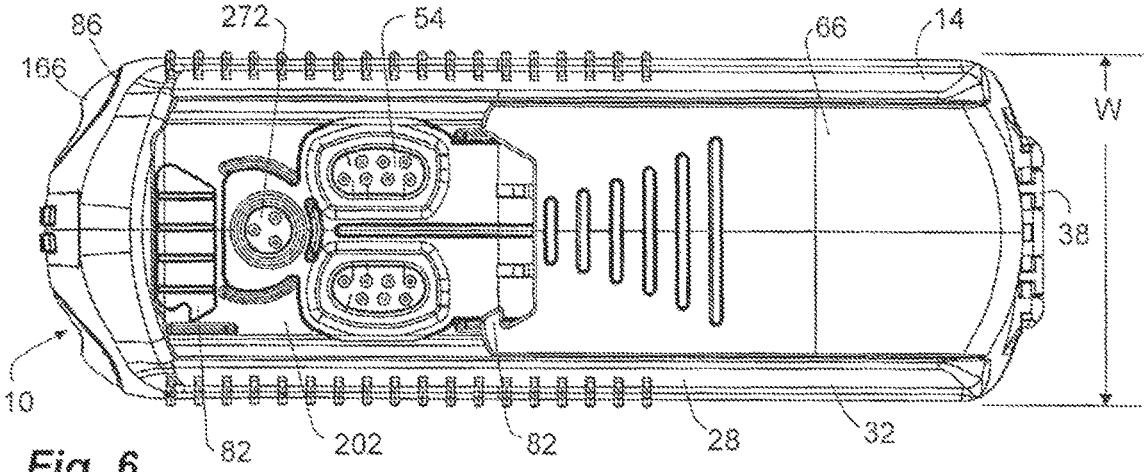
FIG. 6 is a top view of the weapon of FIG. 1, shown with the panel in an open position.
Figure 7:
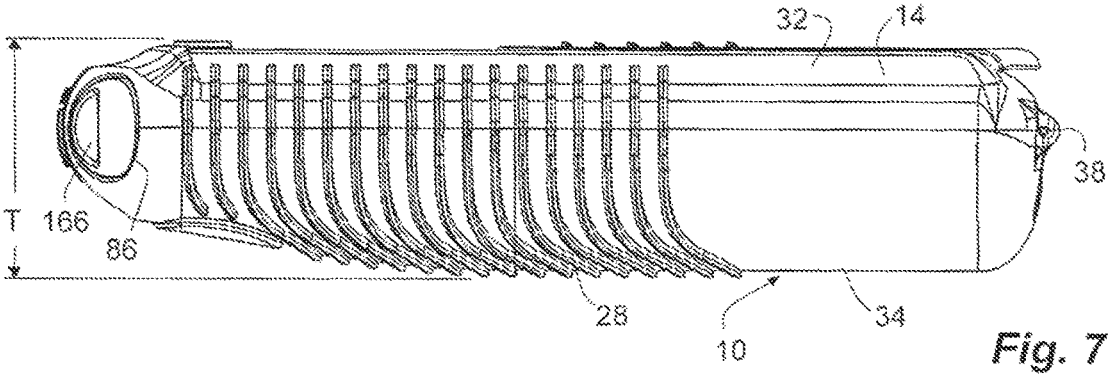
FIG. 7 is a side view of the weapon of FIG. 1.
Figure 8:
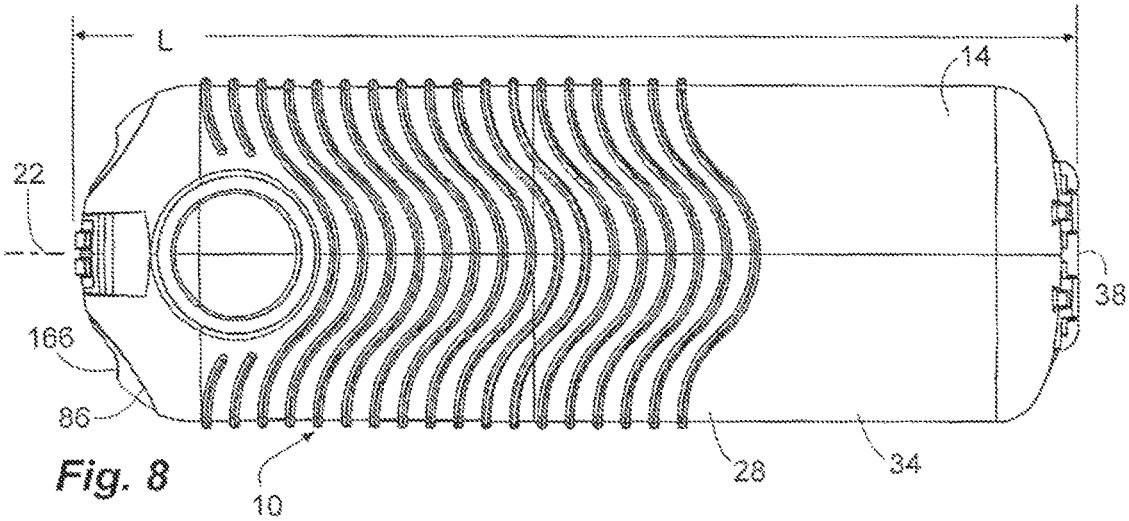
FIG. 8 is a bottom view of the weapon of FIG. 1.
Figure 9:
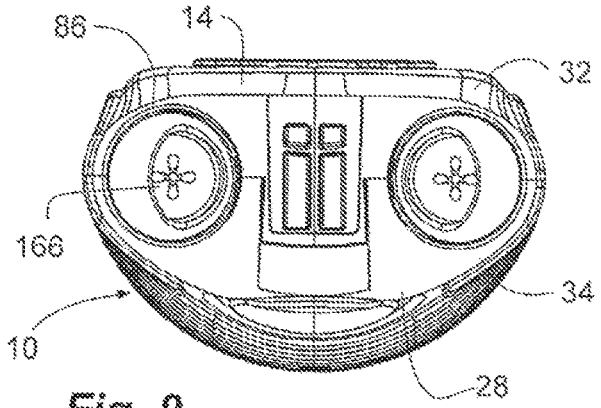
FIG. 9 is a front end view of the weapon of FIG. 1.
Figure 10:
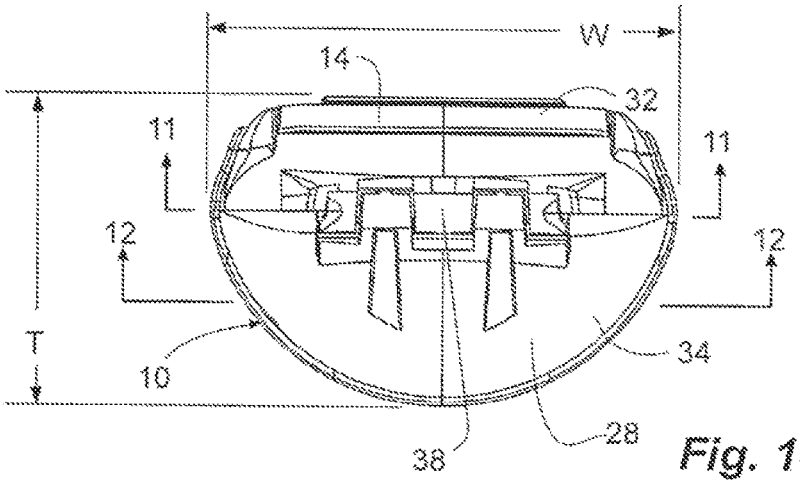
FIG. 10 is a rear end view of the weapon of FIG. 1.

A panel 66 can selectively close the top opening 62 to the recess 58, and can selectively cover the trigger 54. The panel 66 can be a slidable panel slidably carried by the body 14 and the clamshell 28, such as the top shell 32. The panel 66 can slide longitudinally with respect to the longitudinal axis 22. In addition, the panel 66 can slide between at least two positions, including: 1) a closed position in which the panel 66 closes and covering the top opening 62 and covers the trigger 54 to resist engagement of the trigger 54 (FIG. 1); and 2) an open position exposing the trigger 54 (FIGS. 2 and 6). The panel 66 can be slid manually between the open and closed positions. In one aspect, the body 14 and the clamshell 28, such as the top shell 32, can have an indentation 70 therein. A pair of opposing channels 74 can each be located on an opposite side of the indentation 70 and opposing one another across the indentation 70. The panel 66 can be located in the indentation 70 and slidable in the pair of channels 74. Side edges of the panel 66 or tabs on the side edges of the panel 66 can extending into and slide along the channels 74. In one aspect, the panel 66 can reside in the indentation 70 with a top of the panel 66 substantially flush with the top of the body 14, the clamshell 28 and the top shell 32 to resist unintended engagement and movement of the panel 66.

The panel 66 can be locked in the closed position by a transverse lock latch 78. The lock latch 78 can be slidably carried by the body 14 and the clamshell 28, such as the top shell 32. The lock latch 78 can slide laterally with respect to the body 14 and the clamshell 28 in a direction transverse to the direction in which the panel 66 slides, and transverse to the longitudinal axis 22. The lock latch 78 can slide between at least two positions, including: 1) a lock position in which the lock latch 78 engages the sliding panel 66 to resist opening of the sliding panel 66; and 2) an unlock position in which the lock latch 78 is disengaged from the panel 66. In one aspect, the lock latch 78 can be biased in the lock position by a spring. In another aspect, the lock latch 78 and the panel 66 can have a pair of hooks 82 each carried by a different one of the latch 78 and the panel 66, and each hook 82 having an abutment face oriented perpendicularly to the longitudinal axis, and an inclined face. Thus, the inclined faces of the hooks 82 can abut as the panel 66 is slid to the closed position to force the latch 78 to the unlocked position, and the abutment faces can abut in the locked position of the latch 78.

The body 14 and the clamshell 28 have at least one forward opening 86 at the distal end and oriented to face substantially along the longitudinal axis 22. In one aspect, there can be a pair of forward openings 86. In another aspect, the forward opening 86 can be formed between the top and bottom shells 32 and 34. The weapon 10 can have an irritant 90 carried by the body 14 and the clamshell 28, and dispensable or to be expelled through the forward opening 86 in a direction substantially along the longitudinal axis 22 of the body 14 and the clamshell 28, illustrated by lines 94 in FIG. 2. As described above, the trigger 54 can be located away from the distal end of the body 14 and the clamshell 28, and away from the forward opening 86, to resist inadvertent interference with the dispersal of the irritant.

The weapon 10 can also have a propellant 98 carried by the body 14 and the clamshell 28, and separate and distinct from the irritant 90, to dispense the irritant from the body 14 and the clamshell 28. Separating the propellant 98 from the irritant 90 can resist uneven mixing of the two. The trigger 54 is operable to release the propellant 98 to dispense the irritant 90 from the body 14 and the clamshell 28, and through the forward opening 86, as described in greater detail below.

Figure 5:
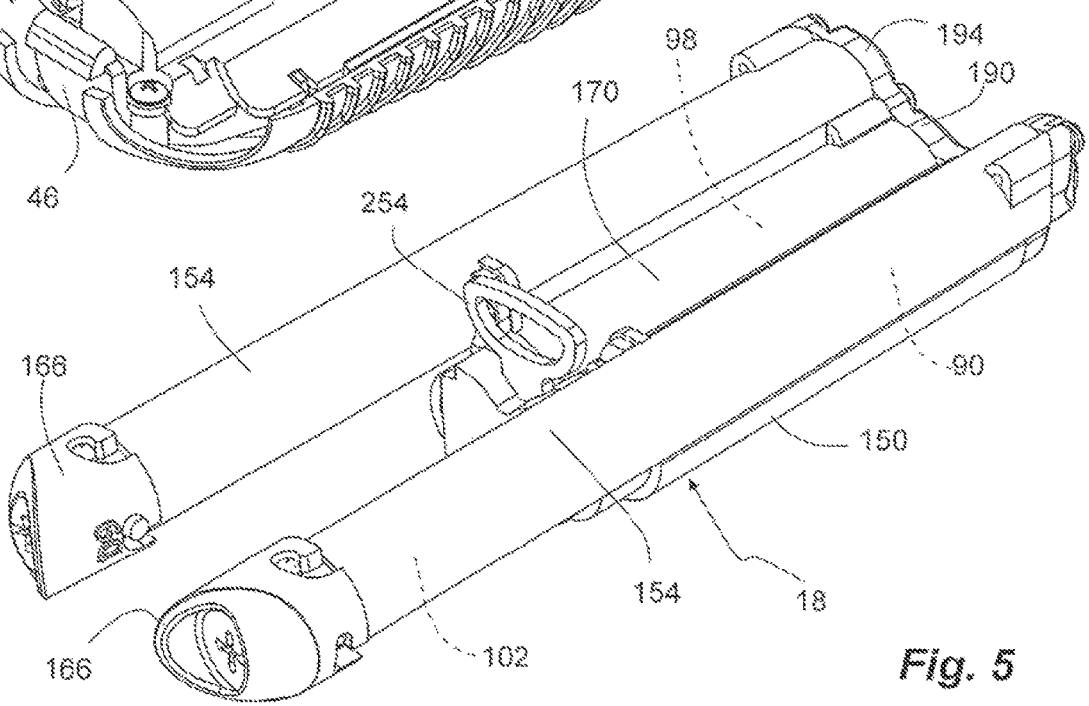
FIG. 5 is a perspective view of a cartridge of the weapon of FIG. 1, shown with a safety cap, in accordance with an embodiment of the invention.

Referring to FIGS. 3-5, the cartridge 18 can be removably and selectively positionable in the cavity 42 of the body 14 and the clamshell 28. The clamshell 28 can be opened by bending the resilient hook 46 away from engagement with the notch 50 and pivoting the top and bottom shells 32 and 34 away from one another about the hinge 38 to expose the cavity 42 and/or the cartridge 18. The cartridge 18 can be inserted into the cavity 42; or one cartridge can be removed from the cavity and another inserted. Thus, a spent cartridge 18 can be replaced with a fresh cartridge; or one type of cartridge (e.g. a gel cartridge) can be replaced by another type of cartridge (e.g. a ball cartridge). The cartridge 18 can carry the irritant 90 and the propellant 98. Thus, the irritant 90 and the propellant 98 can be removably positioned in the cavity 42 of the body 14 and the clamshell 28. The cartridge 18 can also carry a projectile 102 with the irritant 90. The projectile 102 can comprise a gel, a powder or a frangible ball containing the irritant 90. The cartridge 18 will be described with a gel as the projectile 102, defining a gel cartridge.

Referring to FIGS. 5 and 11-14, the cartridge 18 can comprise a housing 150 with a barrel 154. In one aspect, the barrel 154 can be a double barrel comprising a pair of aligned and parallel barrels. When the cartridge 18 is positioned in the cavity 42, an outlet of the barrel 154 can be positioned at the forward opening 86 of the body 14 and the clamshell 28, while an opposite inlet can be positioned at a rear of the body 14 and the clamshell 28. The projectile 102 or the gel with the irritant 90 can be contained in the barrel 154. A plunger 158 can be movably positioned in the barrel 154 near the inlet. The plunger 158 can have a perimeter wiper seal that contacts an interior of the barrel 154 to maintain a seal between the plunger 158 and the barrel 154.

An inverted nozzle 162 can be positioned in the barrel 154 near the outlet. The inverted nozzle 162 can be a valve and can comprise a slit membrane. The inverted nozzle 162 can be inverted in that it faces inwardly into the barrel 154. The membrane can be flexible and resilient such that the slit is maintained closed until a pressure is exerted in the barrel 154 to force the slit open. The projectile 102 or the gel with the irritant 90 is positioned and contained within the barrel 154 between the plunger 158 and the inverted nozzle 162. Together, the barrel 154, the plunger 158 and the inverted nozzle 162 form a container containing the projectile 102 or the gel with the irritant 90.

A nozzle 166 can be carried by the barrel 154 at the outlet of the barrel 154. The nozzle 166 can have a twist attachment with L-shaped elbow channels in the nozzle receiving protruding tabs from the barrel 154. In addition, the nozzle 166 can be positioned at and in the forward opening 86 of the body 14 and the clamshell 28. In one aspect, the nozzle 166 can close the forward opening 86 of the body 14 and the clamshell 28 to form an enclosure and resist entry of debris into the body 14 and the clamshell 28. The nozzle 166 can be a directional nozzle with one or more passages therethrough sized smaller than the forward opening 86 to direct the projectile 102 or the gel. The nozzle 166 can spray the gel with the irritant 90. In another aspect, the nozzle 166 can be oriented to face substantially along the longitudinal axis 22 to expel the projectile 102 or the gel with the irritant 90 substantially along the longitudinal axis 22 of the body 14 and the clamshell 28. Thus, the weapon 10 can be aimed by directing the body 14 and the clamshell 28 at a target. In another aspect, the nozzle 166 can be open and can have a size similar to the forward opening 86 to eject a frangible ball with irritant.

The cartridge 18 and the housing 150 can also have a tube 170 adjacent and proximate the barrel 154, and oriented parallel with the barrel 154. The tube 170 has an outlet positioned adjacent to the inlet of the barrel 154. In one aspect, both the inlet of the barrel 154 and the outlet of the tube 170 can face the rear of the body 14 and the clamshell 28, and can be substantially coplanar and coterminous. The propellant 98 can be carried by and disposed in the tube 170. As with the barrel 154, a pair of tubes 170 can be oriented parallel with one another and positioned spaced-apart in a side-by side relationship. In one aspect, the barrel 154 and the tube 160 can be formed together as a single body. In another aspect, the barrel 154 and the tube 169 can be formed of plastic and can be formed by injection molding.

The propellant 98 can comprise a compressed gas in a compressed gas vessel 174 positioned in the tube 170. In one aspect, the vessel 174 can be a cylinder. In another aspect, the compressed gas 98 can be carbon dioxide (CO2), and the CO2 can be compressed to about 1795 psi. In another aspect, the compressed gas can be nitrogen, and the nitrogen can be compressed to about 2250 psi. In another aspect, the compressed gas can be argon, and the argon can be compressed to about 2750 psi. The compressed gas vessel 174 can be retained from movement in the tube 170, but selectively movably during use. In one aspect, the vessel 174 can be carried by a sleeve 176 in the tube 170. Similarly, the sleeve 176 can be retained from movement in the tube 170, but selectively movably during use. The vessel 174 can face rearward towards the outlet of the tube 170 and opposite the forward outlet 86 of the body 14 and the clamshell 28. The compressed gas vessel 174 has at least two positions, including: 1) a retained position farther from the outlet of the tube 170 and the inlet of the barrel 154, and 2) a released position closer to the outlet of the tube 170 and the inlet of the barrel 154. In one aspect, the sleeve 176 can have two separate open ends, such a rear open end and a forward open end, sealed from one another. The vessel 174 can be inserted into the sleeve 176 through the forward open end, and can extend therefrom. In one aspect, the vessel 174 can be press-fit in the sleeve 176. In another aspect, the vessel 174 can be adhered in the sleeve 176. The sleeve 176 can be formed of metal, such as aluminum, and can be shaped by forging. The vessel 174 can be formed of metal and can have an opening closed by a cap that can be pierced.

A cannula 178 can be carried by the housing 150 and the tube 170. The cannula 178 has a sharp tip positioned to pierce the compressed gas vessel 174 in the released position to release the compressed gas. The cannula 178 can be fluted with at least one flute in the outer surface to facilitate the escape of gas from the vessel 174 and dispersion of the gas. A spring 182 can be positioned in the tube 170 to bias the compressed gas vessel 174 towards the released position and the cannula 178. A retainer 186 can be carried by the tube 170 at a forward end opposite the outlet. The retainer 186 selectively retains the sleeve 176 and the compressed gas vessel 174 in the retained position, as discussed in greater detail below. The spring 182 can be compressed between a flange or step of the sleeve 176 and a step or flange of the tube 170. In one aspect, the spring 182 can be a wave spring. In one aspect, the spring 182 can exert a force greater than 10 lbs.

A diverter 190 can be coupled between the inlet of the barrel 154 and the outlet of the tube 170 and the compressed gas vessel 174. The diverter 190 can have a U-shaped channel or passage that redirects compressed gas 98 from the compressed gas vessel 174 and the tube 170 in a rearward direction towards the inlet of the barrel 154 in a forward direction. Thus, the barrel 154 and the tube 170 with the compressed gas vessel 174 can be positioned adjacent and proximate one another in a side-by-side relationship so that the length L of the body 14 and the clamshell 28 can be reduced for easy of storage, carry, and/or manipulation. The diverter 190 can close the inlet of the barrel 154 and the outlet of the tube 170. In one aspect, the diverter 190 can intercoupled the barrel 154 and the tube 170. In another aspect, the diverter 190 can carry the cannula 178.

In one aspect, a diffuser 194 can be positioned forward of the compressed gas vessel 174 and at the inlet of the barrel 154. And the diffuser 194 can be positioned between the projectile 102 or the gel (and the plunger 158) and the compressed gas vessel 174, and can separate the compressed gas vessel 174 from the projectile 102 and the gel (and the plunger 158). Thus, the diffuser 194 is in a path of travel of the compressed gas 98. The diffuser 194 comprises a passage therethrough to spread out gas 98 from the compressed gas vessel 174 behind the plunger 158 and the projectile 102 with the irritant 90 in the barrel 154. In one aspect, the diverter 190 and the diffuser 194 can be formed together as a single body. The single body can have a passage therethrough and an inlet and an outlet that face in the same direction. The barrel 154, the diverter 190 and/or the diffuser 194, and the tube 170 together form at least a part of the housing 150 of the cartridge 18.

The tube 170, the diverter 190 and/or the diffuser 194 can together define a chamber to accumulate the compressed gas when released from the compressed gas vessel 174. The chamber can have a volume to project the projectile 102 with sufficient speed. In one aspect, the chamber can impart substantially 15 Joules to the projectile 102 and substantially 61 meters per second velocity to the projectile, such as a frangible ball.

The diffuser 194 can be particularly useful if the projectile is a frangible ball. In one aspect, the diffuser 194 can comprise at least one vane in the passage that divides the passage into diffuse pathways. In addition, the diffuser 194 and diffuser body can comprise an outer annulus or rim and an inner hub. The passage extends between the outer annulus and the inner hub. A plurality of vanes can be arrayed circumferentially around the hub and extending between the outer annulus and the inner hub to form a plurality of passages. The diffuser 194 and the passages can have a volume to accumulate gas from the compressed gas cylinder 174 behind the projectile 102.

As described above, the weapon 10 and the cartridge 18 can be double shot. Thus, the weapon 10 and the cartridge 18 can have a pair of barrels 154 and a pair of tubes 170. Each barrel 154 can be paired with a tube 170. The pair of tubes 170 can be coupled together. The pair of barrels 154 can be coupled to the pair of tubes 170, and thus coupled together by the pair of tubes 170. Thus, the cartridge 18 can have a pair of projectiles 102 and a pair of propellants 98, such as a pair of compressed gas vessels 174. The diverter 190 and/or the diffuser 194 can close the inlets of the pair of barrels 154 and the outlets of the pair of tubes 170, and intercouple one of the pair of tubes 170 to one of the pair of barrels 154, and intercouple the other of the pair of tubes 170 with the other of the pair of barrels 154. In addition, the cartridge 18 and the weapon 10 can have a pair of nozzles 166. Furthermore, the cartridge can have a pair of retainers 186 and the weapon 10 can have a pair of triggers 54. The diverter 190 can comprise a pair of diverters with a pair of discrete channels or passages, but a single diverter body. The diffuser 194 can comprise a pair of diffusers with a pair of discrete passages, but a single diffuser body.

The trigger 54 can be carried by the body 14 and the clamshell 28, and can be operated to engage the retainer 186 to release the compressed gas vessel 174 to release the compressed gas 98 to expel the irritant 90 from the barrel 154, the body 14, and the clamshell 28 through the nozzle 166 in the forward opening 86. When the retainer 186 is engaged by the trigger 54, the retainer 186 releases the compressed gas vessel 174 to be driven by the spring 182 against the cannula 178 so that the cannula 178 pierces the compressed gas vessel 174 to release the compressed gas 98. The compressed gas 98 travels rearwardly towards the outlet of the tube 170 where it is redirected by the diverter 190 into the inlet of the barrel 154 in a forward direction. The compressed gas 98 drives the plunger 158 forward to expel the projectile 102 or the gel with the irritant 98 through the inverted nozzle 162 or valve and out of the nozzle 166. The nozzle 166 can have one or more passages to direct the projectile 102 or the gel.

Figure 13:
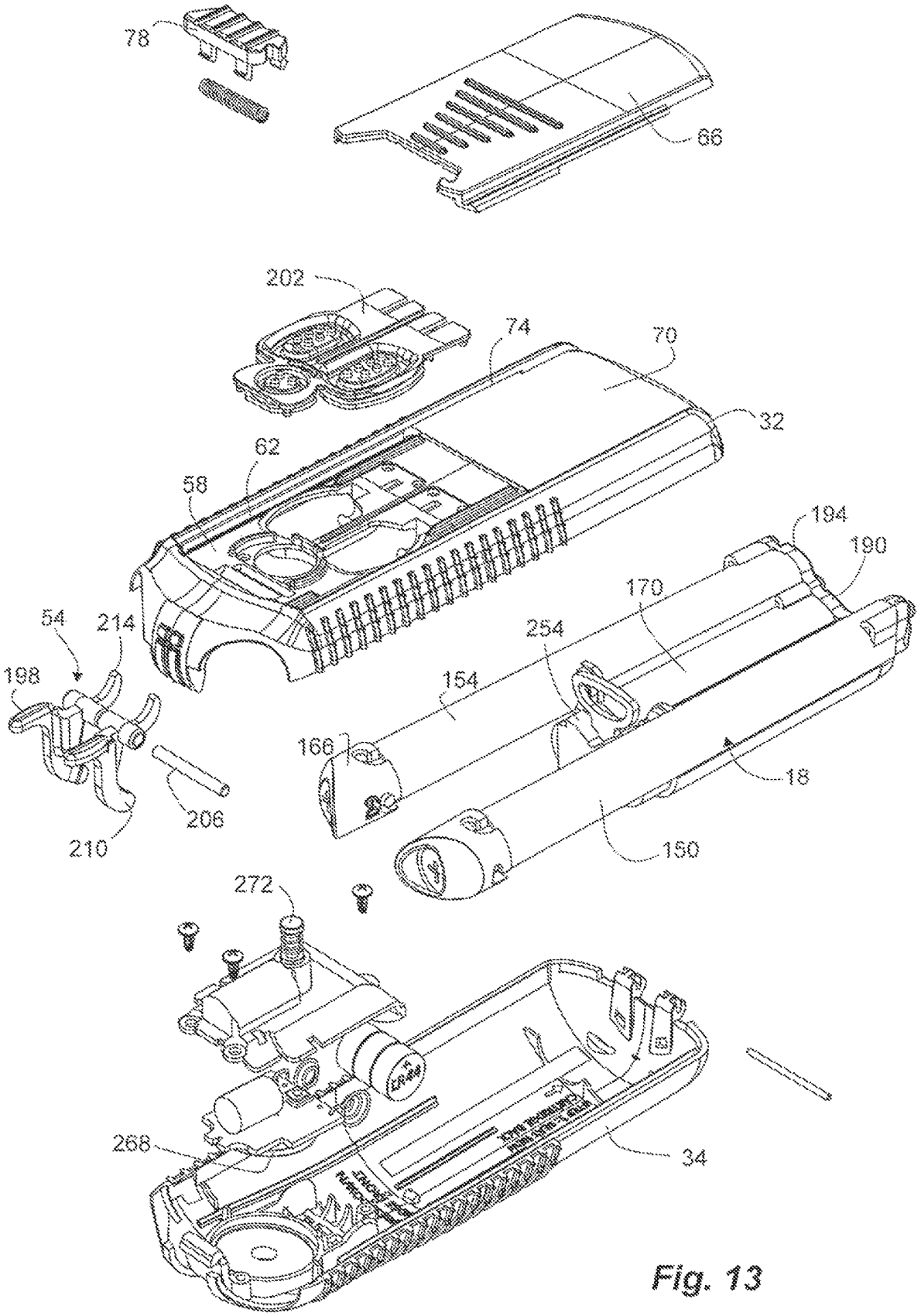
FIG. 13 is an exploded perspective view of the weapon of FIG. 1.
Figure 14:
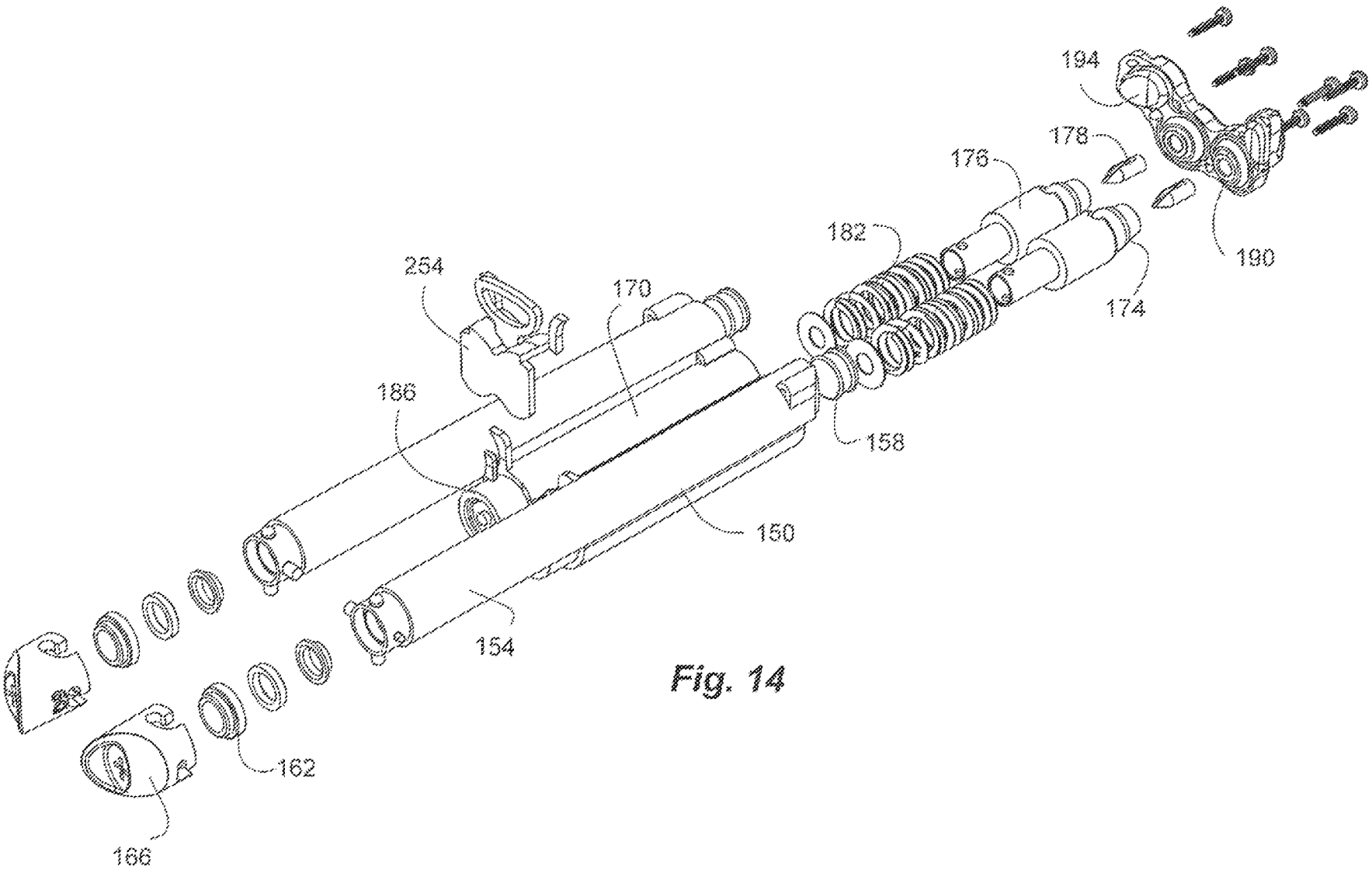
FIG. 14 is an exploded perspective view of the cartridge of FIG. 5.

Referring to FIG. 13, the trigger 54 can have an engagement arm 198 positioned to be engaged during use. For example, the engagement arm 198 can be positioned in the recess 58 in the body 14 and the clamshell 28, and can be accessible through the top opening 62 to the recess 58 in the body 14 and the clamshell 28. In one aspect, a flexible membrane 202 can cover the engagement arm 198. The trigger 54 can have an axle 206 or pivot axis about which the engagement arm 198 can pivot. The trigger 54 can also have an activation arm 210 that can be positioned to engage the retainer 186 and selectively release the irritant 98. The activation arm 210 and the engagement arm 198 can extend from one another and the axle 206 such that movement or pivoting of the engagement arm 198 also moves or pivots the activation arm 210. A safety arm 214 can be positioned to abut to the sliding panel 66 when the sliding panel 66 is in the closed position, but clear the sliding panel 66 when in the open position. The activation arm 210 and the safety arm 214 can be fixed with respect to the engagement arm 198 so that all three pivot together. Thus, when the sliding panel 66 is in the closed position, the safety arm 214 abuts to the sliding panel 66 so that the activation arm 210 cannot be depressed, and the engagement arm 198 cannot engage the retainer 186. But when the sliding panel 66 is in the open position, the safety arm 214 clears the sliding panel 66 so that the activation arm 210 can be depressed and the activation arm 210 can engage the retainer 186.

Figure 15:
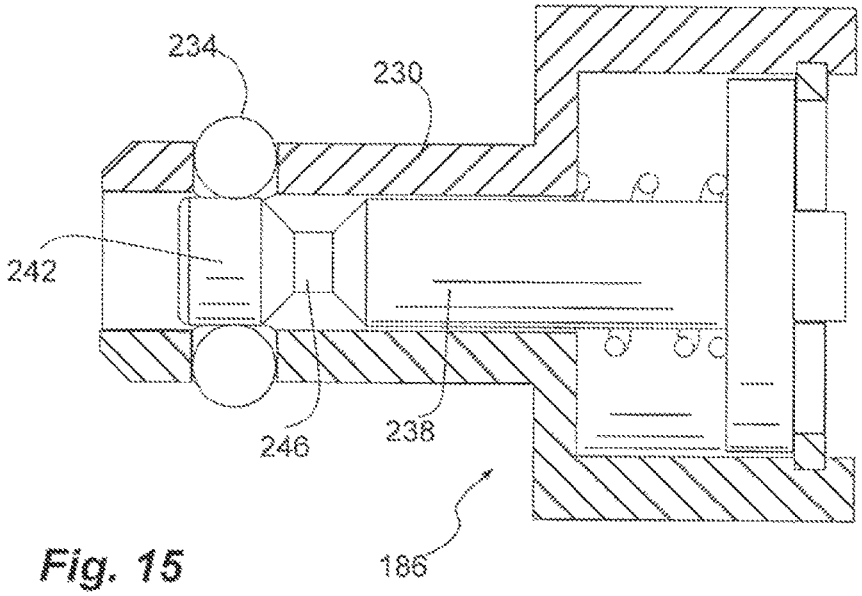
FIG. 15 is a cross-sectional side perspective view of a retainer of the cartridge of FIG. 5.
Figure 11:
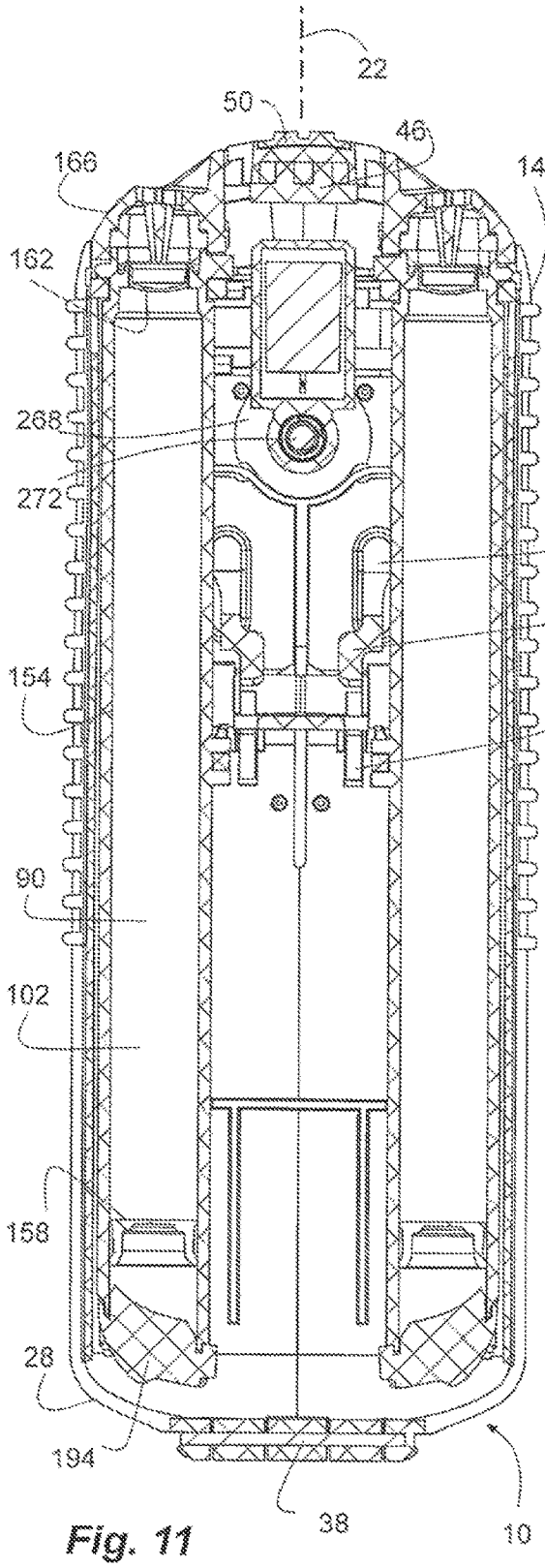
FIG. 11 is a cross-sectional bottom view of the weapon of FIG. 1 taken along line 11-11 of FIG. 10.
Figure 12:
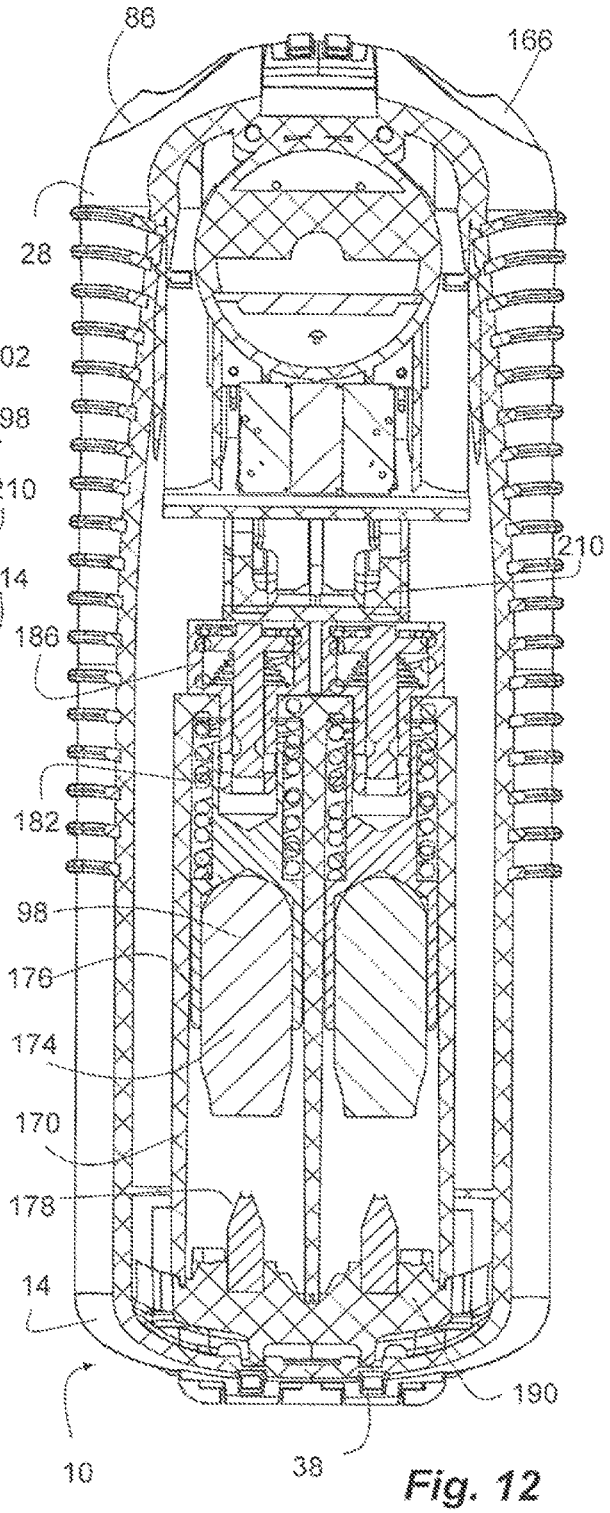
FIG. 12 is a cross-sectional bottom view of the weapon of FIG. 1 taken along line 12-12 of FIG. 10.

Referring to FIGS. 12 and 15, the retainer 186 can be carried by the housing 150 and the tube 170. As described above, the retainer 186 selectively retains the sleeve 176 and the compressed gas vessel 174 in the retained position. The retainer 186 can be carried in the opening of the tube opposite the outlet. In one aspect, the retainer 186 can be or can comprise a ball-lock engaging the open proximal end of the sleeve 176. The retainer 186 and the ball-lock can comprise a pipe 230 held by the tube 170 and extending into the open proximal end of the sleeve 176. The pipe 230 can have an enlargement outside of the sleeve 176 and the tube 170 with a cavity therein.

Balls 234 can be carried by the pipe 230 and can be selectively radially displaceable from: 1) an outer position, to 2) an inner position. In the outer position, the balls 234 are positioned radially outwardly with respect to the pipe 230 to define a combined ball width greater than the open proximal end of the sleeve 176 to retain the sleeve in the retained position. The balls 234 extend between both the pipe 230 and the sleeve 176. In the inner position, the balls 234 are positioned radially inward with respect to the pipe 230 to define a combined ball width less than the open proximal end of the sleeve 176 to allow the sleeve 176 to move to the released position via the spring 182.

A pin 238 is movably positioned in the pipe 230. In addition, the pin 238 can have an enlarged portion 242 displacing the balls 234 to the outer position and a reduced portion 246 allowing the balls 234 to displace to the inner position. The pin 238 can also extend from the pipe 230 to a proximal end with an enlarged head positioned in the cavity of the enlargement. The pin 238 can be biased by a spring. The pipe 230, the enlargement, the balls 234, and the pin 238 can be formed of metal and can be formed by machining, casting or the like. When the trigger 54 is engaged and the activation arm 198 is depressed, the engagement arm 210 engages the enlarged head of the pin 238, displacing the pin 238 and allowing the balls 234 into the reduced portion 246 in the inner position, thus releasing the sleeve 176 and the compressed gas vessel 174.

A safety cap 254 can be carried by the housing 150 and the tube 170 and can circumscribe and cover the proximal end and enlarged head of the pin 238 and the enlargement to resist inadvertent contact with the pin 238, and thus inadvertent release of the sleeve 176 and the vessel 17450. The cap 254 can be removed before use, and can extend to interfere with the top shell 32 so that the clamshell 28 will not close unless the cap 254 is removed.

In another aspect, the projectile can be a frangible ball that can have a shell containing the irritant. The shell can be formed of wax, and the irritant can be, or can be carried by, a powder in the shell. The frangible ball can have a weight of substantially 3 grams, and a diameter of substantially 17 mm.

Multiple different cartridges can be provided with different projectiles, such as gel, powder, and frangible balls. The different cartridges can be similar in many respects. The cartridges can be formed by a cartridge precursor that has many common parts which can be configured with additional parts to form the ball cartridge or the gel or powder cartridge.

In another aspect, the cartridge can comprise a cylindrical container that contains the irritant in a gel or powder form. The container can be displaced and ruptured under force of the compressed gas to eject the gel or powder from the barrel 154. The container of the gel or powder cartridge can remain in the barrel 154, and the gel or powder is expelled from the barrel 154. The gel or powder can be squirted and sprayed from the barrel 154 of the gel or powder cartridge.

The weapon 10, and the launch platform (body 14 and clamshell 28) and the cartridge(s) 18, can be provided in a non-lethal self-protection kit. The kit can comprise at least two cartridges 18. For example, the kit can comprise two cartridges, namely gel or powder cartridges. Or the cartridges can be different. As another example, the kit can comprise three cartridges. Another practice cartridge can also be provided in the kit. The practice cartridge can comprise inert gel or powder without irritant therein. Thus, the practice cartridge can be used to become familiarized with the weapon 10. As described above, the launch platform (body 14 and clamshell 28) interchangeably receives the cartridges 18. In one aspect, the cartridges can have different colors and can thus be color coded. One color can be on the ball cartridge that is indicative of the frangible ball; another different color can be on the gel cartridge that is indicative of the gel; another different color can be on the powder cartridge that is indicative of the powder; and another different color can be on the practice cartridge that is indicative of the frangible ball without irritant.

As discussed above, the components common to both the ball cartridge and the gel or powder cartridge can define a cartridge precursor. Thus, the cartridge precursors can be produced in bulk, and outfitted with a particular projectile.

In another aspect, the body 14 and the clamshell 28, such as the bottom clamshell 34 can carry a siren 268 that can be activated by a button 272 adjacent the triggers 54. The siren 268 can comprise a battery powered piezo.

The body 14 and the clamshell 28 can further carry other self-defense items. In one aspect, at least one LED light can face forwardly to blind an assailant. In another aspect, two LED lights can be provided with different lenses, such as a narrow focus lens, and a wider focus lens. In another aspect, a laser can face forwardly to assist in aiming and deterring an assailant. The lights and laser can be powered by a rechargeable battery carried in the clamshell 28.

It is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The terms "interference fit" and "friction fit" and "press-fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A non-lethal, self-protection weapon, comprising:

a) an elongated body having a length along a longitudinal axis greater than a width and a depth of the body both perpendicular to the longitudinal axis and each other, the body having a forward opening at a distal end of the body oriented to face substantially along the longitudinal axis;

b) an irritant carried by the body and dispensable through the forward opening in a direction substantially along the longitudinal axis of the body;

c) a propellant carried by the body and separate and distinct from the irritant to dispense the irritant from the body;

d) a push-button trigger carried by the body and located in a recess of the body with an opening in the body to the recess, the trigger operable to release the propellant to dispense the irritant from the body through the forward opening; and e) a sliding panel slidably carried by the body and sliding between open and closed positions to selectively close the opening to the recess and selectively cover the push-button trigger.

2. The weapon in accordance with claim 1, wherein the trigger further comprises:

a) an engagement arm positioned to be engageable during use;

b) an activation arm positioned to selectively release of the irritant; and c) a safety arm positioned to abut to the sliding panel when in the closed position but clear the sliding panel when in the open position.

3. The weapon in accordance with claim 1, further comprising:

a) an indentation in the body;

b) a pair of opposing channels each located on an opposite side of the indentation and opposing one another across the indentation; and c) the panel located in the indentation and slidable in the pair of channels.

4. The weapon in accordance with claim 1, further comprising:

a) a transverse lock latch slidably carried by the body;

b) the lock latch slidable with respect to the body in a direction transverse to a direction in which the panel is slidable; and c) the lock latch sliding between at least two positions, including:

i) a lock position in which the lock latch engages the sliding panel to resist opening of the sliding panel; and ii) an unlock position in which the lock latch is disengaged from the panel.

5. The weapon in accordance with claim 1, wherein the body further comprises:

a) a clamshell having top and bottom shells pivotally coupled together about a rear hinge and defining a cavity therein;

b) the shells pivoting between at least two positions, including:

i) a closed orientation enclosing the cavity; and ii) an open orientation in which the shells are separated and exposing the cavity; and c) the forward opening formed between the top and bottom shells;

d) the trigger carried by the top shell.

6. The weapon in accordance with claim 5, further comprising:

a cartridge removably and selectively positionable in the cavity of the clamshell, the cartridge carrying the irritant and the propellant.

7. The weapon in accordance with claim 1, further comprising:

a cartridge removably and selectively positionable in a cavity of the body, the cartridge comprising:

a) a barrel with an outlet positionable at the forward opening of the body and an opposite inlet positionable at a rear of the body;

b) the irritant contained in the barrel;

c) a tube having an outlet positioned adjacent to the inlet of the barrel;

d) the propellant comprises a compressed gas vessel positioned in the tube and facing rearward towards the outlet of the tube and opposite the forward outlet of the body, the compressed gas vessel containing a compressed gas, the compressed gas vessel having two positions comprising:

i) a retained position farther from the outlet of the tube and the inlet of the barrel, and ii) a released position closer to the outlet of the tube and the inlet of the barrel;

e) a diverter coupled between the inlet of the barrel and the outlet of the tube and the compressed gas vessel to redirect compressed gas from the compressed gas vessel and the tube in a rearward direction towards the inlet of the barrel in a forward direction;

f) a spring positioned in the tube to bias the compressed gas vessel towards the released position;

g) a retainer carried by the tube and selectively retaining the compressed gas vessel in the retained position; and h) a cannula carried by the diffuser and having a sharp tip positioned to pierce the compressed gas vessel in the released position to release the compressed gas.

8. The weapon in accordance with claim 7, wherein the cartridge further comprises:

a) a nozzle carried by the cartridge at the outlet of the barrel of the cartridge;

b) the nozzle positioned in and closing the forward opening of the body; and c) the nozzle oriented to face substantially along the longitudinal axis.

9. The weapon in accordance with claim 7, wherein the cartridge further comprises:

a) a plunger positioned in the barrel near the inlet;

b) an inverted nozzle positioned in the barrel near the outlet and comprising a slit membrane; and c) the irritant positioned in the barrel between the plunger and the inverted nozzle.

10. The weapon in accordance with claim 7, wherein the cartridge further comprises:

a) a pair of barrels oriented parallel with one another and positioned spaced-apart in a side-by-side relationship;

b) a pair of tubes oriented parallel with one another and positioned spaced-apart in a side-by side relationship;

c) the pair of tubes attached to one another and pair of barrels coupled together by the pair of tubes; and d) the diverter closing the inlets of the pair of barrels and the outlets of the pair of tubes, and intercoupling one of the pair of tubes to one of the pair of barrels, and intercoupling the other of the pair of tubes with the other of the pair of barrels.

11. The weapon in accordance with claim 1, wherein the trigger further comprises:

a) an engagement arm positioned in the recess of the body and pivotal about a pivot axis; and b) a flexible membrane covering the engagement arm.

12. The weapon in accordance with claim 1, further comprising:

a) a transverse lock latch slidably carried by the body and slidable with respect to the body in a direction transverse to a direction in which the panel is slidable; and b) wherein the lock latch, the panel and the trigger operate in three different and transverse directions with respect to one another with the panel slidable between the open and closed positions, the lock latch slidable transverse to the direction in which the panel is slidable, and the trigger depressible in a direction transverse to the directions in which the lock latch and the panel are slidable.

13. A non-lethal, self-protection weapon, comprising:

a) a clamshell having top and bottom shells pivotally coupled together about a rear hinge and defining a cavity therein, the clamshell having a forward opening, the shells pivoting between at least two positions, including:

i) a closed orientation enclosing the cavity; and ii) an open orientation in which the shells are separated and exposing the cavity;

b) a cartridge removably and selectively positionable in the cavity of the clamshell, the cartridge comprising:

i) an irritant dispensable from the clamshell through the forward opening;

ii) a propellant separate and distinct from the irritant to dispense the irritant from the clamshell; and c) a trigger carried by the clamshell and located on a side of the clamshell away from the outlet, the trigger operable to release the propellant to dispense the irritant from the clamshell through the forward opening.

14. The weapon in accordance with claim 13, further comprising:

a resilient hook extending from one of the shells and a notch formed in the other shell with the resilient hook releasably engaging the notch to selectively hold the shells in the closed orientation.

15. The weapon in accordance with claim 13, further comprising:

a) the clamshell having a length along a longitudinal axis greater than a width and a depth of the clamshell both perpendicular to the longitudinal axis and each other;

b) the forward opening located at a distal end of the clamshell and oriented to face substantially along the longitudinal axis; and c) the nozzle oriented to expel the irritant substantially along the longitudinal axis of the clamshell.

16. The weapon in accordance with claim 13, further comprising:

a) a sliding panel slidably carried by the top shell of the clamshell;

b) the sliding panel sliding between at least two positions, including:

i) a closed position in which the sliding panel covers the trigger to resist engagement of the trigger; and ii) an open position exposing the trigger.

17. The weapon in accordance with claim 13, wherein the cartridge further comprises:

a) a barrel with an outlet;

b) the irritant contained in the barrel c) a nozzle carried by the barrel at the outlet and positionable at the forward opening of the clamshell; and d) the propellant comprising a compressed gas vessel associated with the barrel and containing a compressed gas capable of expelling the irritant from the barrel through the nozzle.

18. The weapon in accordance with claim 13, wherein the cartridge further comprises:

a) a barrel with an outlet positionable at the forward opening of the clamshell and an opposite inlet positionable at a rear of the clamshell;

b) the irritant contained in the barrel;

c) a tube having an outlet positioned adjacent to the inlet of the barrel;

d) the propellant comprising a compressed gas vessel positioned in the tube and facing rearward towards the outlet of the tube and opposite the forward outlet of the clamshell, the compressed gas vessel having two positions comprising:

i) a retained position farther from the outlet of the tube and the inlet of the barrel, and ii) a released position closer to the outlet of the tube and the inlet of the barrel;

e) a diverter coupled between the inlet of the barrel and the outlet of the tube and the compressed gas vessel to redirect compressed gas from the compressed gas vessel and the tube in a rearward direction towards the inlet of the barrel in a forward direction;

r) a diffuser positioned in front of the compressed gas vessel, the diffuser comprising a passage therethrough configured to spread out gas from the compressed gas vessel behind the irritant in the barrel;

g) a spring positioned in the tube to bias the compressed gas vessel towards the released position;

h) a retainer carried by the tube and selectively retaining the compressed gas vessel in the retained position; and i) a cannula carried by the diffuser and having a sharp tip positioned to pierce the compressed gas vessel in the released position to release the compressed gas.

19. A non-lethal, self-protection weapon, comprising:

a) a clamshell having top and bottom shells pivotally coupled together about a rear hinge and defining a cavity therein, the shells pivoting between at least two positions, including:

i) a closed orientation enclosing the cavity; and ii) an open orientation in which the shells are separated and exposing the cavity;

b) the clamshell having a length along a longitudinal axis greater than a width and a depth of the clamshell both perpendicular to the longitudinal axis and each other;

c) the clamshell having a forward opening between the top and bottom shells, the forward opening located at a distal end of the clamshell and oriented to face substantially along the longitudinal axis;

d) a cartridge removably and selectively positionable in the cavity of the clamshell, the cartridge comprising:

i) a barrel with an outlet positionable at the forward opening of the clamshell and an opposite inlet positionable at a rear of the clamshell;

ii) a nozzle carried by the barrel at the outlet and positionable at the forward opening of the clamshell, the nozzle oriented to face substantially along the longitudinal axis of the clamshell;

iii) a plunger positioned in the barrel near the inlet;

iv) an inverted nozzle positioned in the barrel near the outlet and comprising a slit membrane;

v) irritant contained in the barrel between the plunger and the inverted nozzle vi) a tube having an outlet positioned adjacent to the inlet of the barrel;

vii) a compressed gas vessel positioned in the tube and facing rearward towards the outlet of the tube and opposite the forward outlet of the clamshell, the compressed gas vessel containing a compressed gas, the compressed gas vessel having two positions comprising:

A) a retained position farther from the outlet of the tube and the inlet of the barrel, and B) a released position closer to the outlet of the tube and the inlet of the barrel;

viii) a diverter coupled between the inlet of the barrel and the outlet of the tube and the compressed gas vessel to redirect compressed gas from the compressed gas vessel and the tube in a rearward direction towards the inlet of the barrel in a forward direction;

ix) a spring positioned in the tube to bias the compressed gas vessel towards the released position;

x) a retainer carried by the housing and selectively retaining the compressed gas vessel in the retained position; and xi) a cannula carried by the diffuser and having a sharp tip positioned to pierce the compressed gas vessel in the released position to release the compressed gas;

e) a trigger carried by the clamshell and operable to engage the retainer to release the compressed gas vessel to release the compressed gas to expel the irritant from the clamshell through the nozzle in the forward opening; and f) a sliding panel slidably carried by the top shell of the clamshell, the sliding panel sliding between at least two positions, including:

i) a closed position in which the sliding panel covers the trigger to resist engagement of the trigger; and ii) an open position exposing the trigger.

20. The weapon in accordance with claim 19, wherein the trigger further comprises:

a) an engagement arm positioned to be engageable during use;

b) an activation arm positioned to selectively release of the irritant; and c) a safety arm positioned to abut to the sliding panel when in the closed position but clear the sliding panel when in the open position.

* * * * *